United States Patent [19]

Abe et al.

[11] 4,213,440

[45] Jul. 22, 1980

[54] LOW-NOISE-LEVEL RECIPROCATING PISTON ENGINE

[75] Inventors: Fumiyuki Abe; Yoshimasa Hayashi, both of Yokohama; Akira Kimura, Kawasaki, all of Japan

[73] Assignee: Nissan Motor Company, Limited, Yokohama, Japan

[21] Appl. No.: 962,920

[22] Filed: Nov. 22, 1978

[30] Foreign Application Priority Data

Nov. 26, 1977 [JP] Japan ..... 52/142432

[51] Int. Cl.[2] ..... F02F 7/00

[52] U.S. Cl. ..... 123/195 C; 123/198 E; 123/DIG. 6

[58] Field of Search ..... 123/198 E, 195 C, 195 S, 123/193 CH, 195 R, DIG. 6, DIG. 7

[56] References Cited

U.S. PATENT DOCUMENTS

| | | | |
|---|---|---|---|
| Re. 16,909 | 3/1928 | West | 123/195 R |
| 1,135,524 | 4/1915 | Hewitt | 123/195 R |
| 1,996,211 | 4/1935 | Mutchler | 123/195 S |
| 2,837,075 | 6/1958 | Leach | 123/195 R |
| 2,865,341 | 12/1958 | Dolza | 123/195 R |
| 3,796,280 | 3/1974 | Thien et al. | 123/198 E |
| 3,991,735 | 11/1976 | Horstmann | 123/195 C |
| 4,071,008 | 1/1978 | Skatsche | 123/195 C |
| 4,092,956 | 6/1978 | List et al. | 123/193 CH |

*Primary Examiner*—Ira S. Lazarus

[57] ABSTRACT

A reciprocating piston internal combustion engine comprises an engine block formed with first bearing carrying portions which carry a group of upper generally semicylindrical parts of main bearings for supporting a crankshaft, and a bearing support block secured to the engine block and formed with second bearing carrying portions which carry a group of lower generally semicylindrical parts of the main bearing, so that the engine block is reinforced to prevent generation of engine noises due to low flexural rigidity of the engine block.

19 Claims, 5 Drawing Figures

LOW-NOISE-LEVEL RECIPROCATING PISTON ENGINE

BACKGROUND OF THE INVENTION

This invention relates to a low-noise level internal combustion engine, more particularly to a reciprocating piston internal combustion engine provided with means for suppressing engine noise at a considerable low level.

In conventional reciprocating piston engines, the journal of a crankshaft is rotatably supported by main bearings whose upper half parts are carried by a cylinder block. The lower half parts of the main bearings are carried by bearing caps which are secured to the bottom portion of the cylinder block by means of bolts. Additionally, the cylinder block is integrally provided at its bottom portion with a skirt portion which bulge out to spacedly cover the rotating crankshaft. An oil pan for reserving an engine oil is sealingly secured to the skirt portion.

With such conventional engines, the oil pan is constructed and arranged to serve only as a container for the engine oil. Therefore, the oil pan does not contribute to increase in flexural rigidity of the engine, and additionally serves as means through which the explosion sounds in engine cylinders and the bearing sounds are radiated out of the engine. Additionally, the bulged skirt portion of the cylinder block is liable to vibrate and accordingly serves as a source of engine noises.

SUMMARY OF THE INVENTION

It is the main object of the present invention to provide an improved reciprocating piston internal combustion engine, whose engine noise can be suppressed to a considerably low level.

Another object of the present invention is to provide an improved reciprocating piston internal combustion engine, in which the flexural rigidity of its engine block is increased to decrease flexural movement in the longitudinal direction of the engine body.

A still another object of the present invention is to provide an improved reciprocating piston internal combustion engine, in which the engine noise due to low flexural rigidity of its engine block can be prevented by reinforcing the engine block with bearing support block which is secured to the bottom portion of the engine block.

A further object of the present invention is to provide an improved reciprocating internal combustion engine, in which the engine noises to be radiated from the engine block wall can be prevented from being emitted out of the engine, by means of a sound-insulating cover for covering the engine block and a main bearing support block secured to the bottom portion of the engine block.

A still further object of the present invention is to provide an improved reciprocating internal combustion engine, in which engine vibration is suppressed by employing so-called short-stroke or over-square arrangement, and generation of the engine noise can be suppressed by integrally forming or casting an engine block including a cylinder block portion and a cylinder head portion, in addition to the fact that the engine block is reinforced with a main bearing support block secured to the bottom portion of the engine block.

Other objects, features and advantages of the improved reciprocating piston internal combustion engine will become more apparent from the followng description taken in conjunction with the accompanying drawings.

DESCRIPTION OF THE PREFERRED EMBODIMENT

Referring now to FIGS. 1 to 5 of the drawings, there is shown a preferred embodiment of a reciprocating piston internal combustion engine 10 in accordance with the present invention. In this instance, the engine 10 is of a motor vehicle or automobile and comprises an engine block 12. The engine block 12 is formed or cast integrally and accordingly a cylinder head portion **12*a* is formed or casted integrally with a cylinder block portion 12*b*** which is formed therein with in-line four cylinders $C_1$ to $C_4$.

Figure 1:
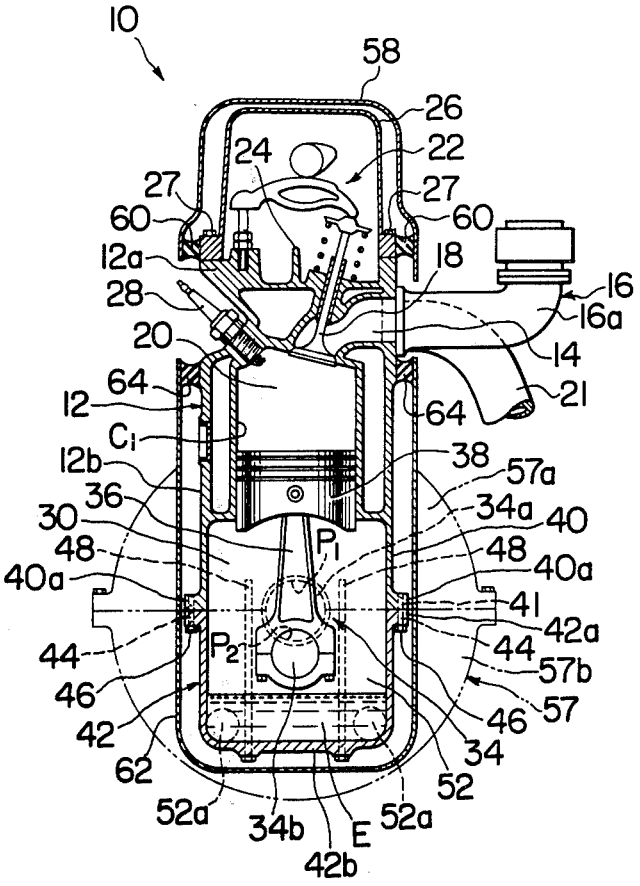
FIG. 1 is a schematic cross-sectional view of a preferred embodiment of a reciprocating piston internal combustion engine in accordance with the present invention.

The cylinder head portion **12*a* is formed with intake and exhaust ports 14 and 15, although only intake port 14 is shown in FIG. 1. The intake port 14 connects to a branch runner 16*a* of an intake manifold 16. The intake port 14 is communicable through an intake valve 18 with a combustion chamber 20 formed at the uppermost part of each cylinder. Of course, the exhaust port 15 is communicable through an exhaust valve(not shown) with the combustion chamber 20, and connects to an exhaust manifold 21, though not shown. The intake and exhaust valves are opened or closed by the action of a valve operating mechanism 22. The reference numeral 24 denotes an elongate rib formed on the top surface of the cylinder head portion 12*a*, which rib 24 is extended along the longitudinal direction of the engine block 12. A rocker cover 26 is secured to the top surface of the cylinder head portion 12*a* by means of bolts 27. As shown, a spark plug 28 is securely, as usual, mounted on the cylinder head portion 12*a* so that its electrodes (no numerals) are projected into the combustion chamber 20**.

The cylinder block portion **12*b* is formed at its bottom portion with bearing carrying portions 30. Each bearing carrying portion 30 carries an upper generally semicylindrical part $P_1$ of a main bearing 32. The main bearings 32 support the rotatable journal 34*a* of a crankshaft 34. A connecting rod 36 is rotatably mounted on the piston pin 34*b* of the crankshaft 34 and movably connected to a piston 38. The piston 38 is reciprocally movably disposed in each cylinder to define the combustion chamber 20 between it and the cylinder head portion 12*a*. In this instance, the piston stroke of each piston 38 is smaller than the bore diameter of each cylinder and therefore this engine 10 is of so-called over-square type or of short-stroke type. The engine block 12 is integrally provided with a bottom cover wall portion 40** which has at its bottom periphery a flange portion 40*a*. As viewed, a plurality of threaded holes 41 are formed at the flange portion 40*a*. It is to be noted that the bottom cover wall portion 40 is arranged generally flat and accordingly noises of the engine block 12 can not be amplified thereby.

A bearing support block 42 of the shape of a vessel is provided at its top periphery with a flange portion 42*a* which contacts the flange portion 40*a* of the bottom cover wall portion 40 of the cylinder block 12. As shown, the flange portion 42*a* is formed with through holes 44 through which bolts 46 enter the threaded holes 41 formed at the flange portion 40*a* of the cover wall portion 40 in order to secure the bearing support block to the engine block 12. Moreover, the bearing support block 12 is secured to the engine block 12 by means of bolts 48. Two bolts 48 are disposed, respectively, in two elongate through holes 50 which are formed through the bottom wall 42*b* of the bearing support block and each bearing carrying portion 52, and screwed into two threaded holes 51 formed at each bearing carrying portions 30 of the cylinder block portion 12*b*. Each bearing carrying portion 52 carries a lower generally semicylindrical part $P_2$ of each main bearing 32. It will be understood that the lower generally semicylindrical part $P_2$ constitutes a generally cylindrical main bearing 32 in cooperation with the upper generally semicylindrical part $P_1$ carried by the bearing support portion 30 of the engine block 12. The two elongate through holes 50 are formed adjacent the main bearing 32 and generally symmetrically with each other with respect to the main bearing 32. Each through hole 50 lies substantially parallelly with the axes(not shown) of the cylinders $C_1$ to $C_4$. It is preferable that the bottom wall 42*b* of the bearing support block 42 is larger in thickness than the other walls of the block 42, in order that the bottom wall 42*b* serves also as a beam for increasing the flexural rigidity in the longitudinal direction of the bearing support block 42.

Figure 3:
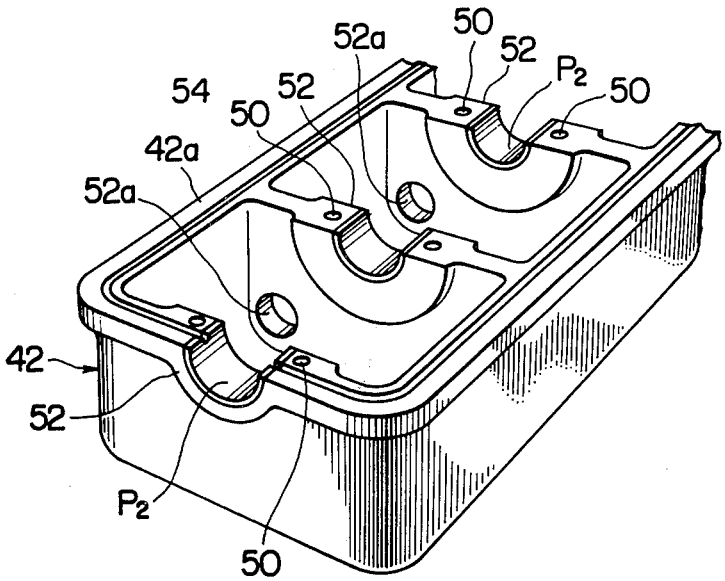
FIG. 3 is a partially cutaway view in perspective of a main bearing support block of the engine of FIG. 1.
Figure 4:
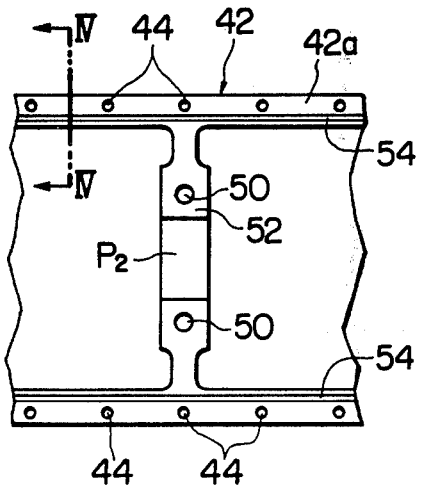
FIG. 4 is a partially cutaway view in plan of the main bearing support block of FIG. 3.
Figure 5:
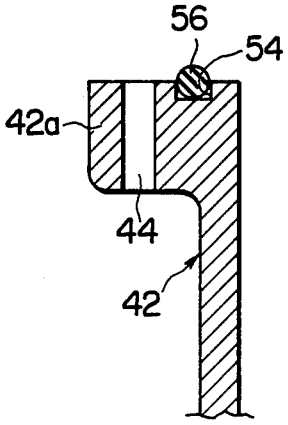
FIG. 5 is a cross-sectional view taken in the direction of the arrows substantially along the line IV—IV of FIG. 4.

As clearly shown in FIGS. 3 to 5, each bearing support portion 52 of the bearing support block 42 is in the form of a partition wall and accordingly an engine oil chamber(no numeral) in which engine oil E is filled is defined between the two adjacent bearing support portions 52. It is to be noted that some bearing support portions 52 are formed with openings 52*a*, respectively, through which the engine oil chambers communicate with each other in order that the bearing support block 42 serves also as an oil pan for an engine oil E. The flange portion 42*a* of the bearing support block 42 is formed at its top surface with a groove 54 in which an elongate elastomeric sealing member 56 is disposed as viewed in FIG. 5. The sealing member 56 provides liquid-tight and gas-tight seals between the flange portions 40*a* of the engine block 12 and the flange portion 42*a* of the bearing support block 42.

Figure 2:
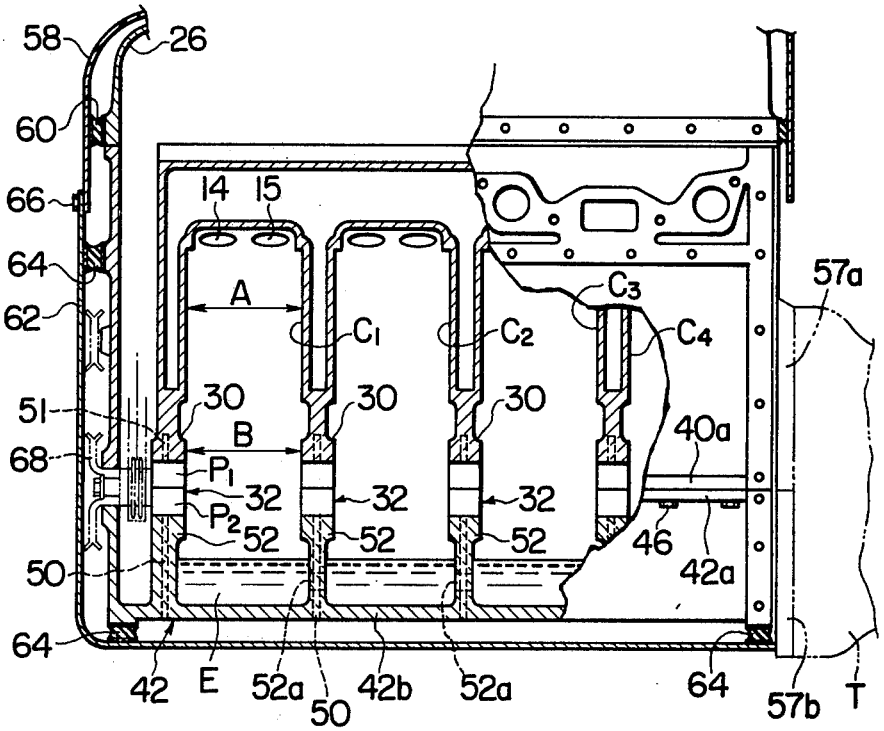
FIG. 2 is a side elevation, partly in section, of the engine of FIG. 1.

The cylinder block 12 is formed integrally with an upper semicircular plate member 57*a* of a generally circular flange 57 to which a transmission case T is secured as indicated in phantom in FIGS. 1 and 2. The bearing support block 42 is formed integrally with a lower semicircular plate member 57*b* which is secured to the plate member 57*a* by means of bolts(no numerals) to constitute the flange 57.

An upper sound-insulating cover 58 is secured through an elastomeric member 60 to the lower-most portion of the rocker cover 26 in spaced relation to the outer surface of the rocker cover 26 to cover the rocker cover 26. Similarly, a lower sound-insulating cover 62 is secured through elastometric members 64 to the engine block 12 and the bearing support block 42. The upper and lower sound-insulating covers 58 and 62 are separate from each other adjacent the branch runners of the intake manifold 16 as seen from FIG. 1, but connected to each other at the front portion of the engine 10 by using bolts 66 shown in FIG. 2. In this instance, the bore diameter A of the cylinder is arranged to be smaller than the distance B between the adjacent two main bearings 32 as clearly shown in FIG. 2. In FIG. 2, the reference numeral 68 denotes a crank pulley.

It will be understood that the short-stroke engine such as the engine 10 is considerably small in the force of inertia of reciprocally moving engine parts and accordingly can provide advantages in suppression of engine vibration. However, since the height of the engine block of such the engine inevitably becomes small permitting the flexural rigidity of the engine cylinder to be lowered, engine noises due to the low flexural rigidity of the engine block is liable to be generated. Nevertheless, according to the present invention, such generation of the engine noises are effectively suppressed by increasing the flexural rigidity of the engine block 12 using the rigid bearing support block 42 to be secured to the engine block 12.

As will be appreciated from the foregoing discussion, the engine 10 constructed in accordance with present invention can provide the following advantages:

(1) The flexural rigidity of the engine block 12 is improved to a considerable extent and accordingly generation of engine noises due to the low flexural rigidity is effectively prevented. Additionally, installation of the lower half parts of the main bearings becomes easy, contributing to simplication of engine assembly.

(2) The cylinder head portion 12*a* and the cylinder block portion 12*b* are integrally formed or cast and therefore the assembly process of the engine can be simplified lowering the production cost.

(3) Since the cylinder block portion 12*b* is not provided with a skirt portion which bulges out and extends below the level of the axis of the crankshaft 34, the engine noises radiated out of the engine is diminished to a considerable extent.

(4) The engine block 12 with the bearing support block 42 are integrally formed with the circular flange 57 to which the transmission case T is secured. Therefore, the flexural rigidity of the connection between the engine and an engine transmission considerably improved, decreasing the noise level in a passenger compartment.

(5) The engine oil is prevented from leaking through the contacting plane of the engine block 12 and the bearing support block 42, since a tight sealing at the contacting plane is not liable to be loosened.

(6) The sound-insulating covers 58 and 62 are not required to have oil maintaining functions and acocrdingly the constructions thereof are simplified and the production costs thereof are lower.

(7) Each bearing carrying portion or wall 52 of the bearing support block 42 serves as a baffle plate for preventing the engine oil from its free movement. Therefore, particular baffle plates are not necessary for the bearing support block 42.

What is claimed is:

1. A reciprocating piston internal combustion engine comprising:

an engine block including a cylinder block portion in which engine cylinders are formed, and a cylinder head portion to close one ends of the cylinder to define combustion chambers between it and the crowns of pistons reciprocally disposed in the cylinders, respectively, said engine block being formed with first bearing carrying portions which carry a group of upper generally semi-cylindrical parts of main bearings for supporting the journal of a crankshaft mechanically connected to the pistons; and a bearing support block sealingly secured to said engine block and formed with a cavity to be filled with an engine lubricating oil for operating the engine so that said bearing support block serves as an oil pan, said bearing support block being formed with second bearing carrying portions which carry a group of lower generally semi-cylindrical parts of the main bearings, each lower generally semi-cylindrical part constituting a generally cylindrical main bearing in cooperation with each upper generally semi-cylindrical part.

2. A reciprocating piston internal combustion engine as claimed in claim 1, in which the cylinder block portion of said engine block is formed integrally with the cylinder head portion of said engine block.

3. A reciprocating piston internal combustion engine as claimed in claim 2, in which said engine block is produced by being integrally cast so that the cylinder head portion is cast integrally with the cylinder block portion.

4. A reciprocating piston integral combustion engine as claimed in claim 2, in which the piston stroke of each piston is smaller than the bore diameter of each cylinder.

5. A reciprocating piston internal combustion engine as claimed in claim 4, further comprising a flange to which a transmission case is secured, said flange including a first member which is integral with said engine block, and a second member which is integral with said bearing support block, said first and second member being secured to each other.

6. A reciprocating piston internal combustion engine as claimed in claim 5, said bearing support block is formed with a flange portion which is secured to a flange portion formed at cylinder block portion of said engine block by means of a plurality of bolts.

7. A reciprocating piston internal combustion engine as claimed in claim 6, in which the flange portion of said bearing support block has a flat surface which is contactable with the flat surface of the flange portion of said cylinder block, the flange portion of said bearing support block being formed at its flat surface with a groove receiving an elongate elastomeric seal member for providing an oil-tight seal between the contacting flat surfaces of the flange portions of said bearing block and engine block.

8. A reciprocating piston internal combustion engine as claimed in claim 6, in which each of said second bearing carrying portion of said bearing support block is of the shape of a partition wall defining an engine oil chamber, said second bearing carrying portion being formed with two elongate through holes for receiving two bolts, respectively, which are screwed into said engine block to secure said bearing support block to said engine block, said two elongate through holes lying substantially parallelly with the axes of the engine cylinders and generally symmetrically to each other with respect to the lower generally semicylindrical part of the main bearing, at least one of said second main bearing carrying portion being formed with an opening through which the adjacent engine oil chambers communicate with each other.

9. A reciprocating piston internal combustion engine as claimed in claim 1, further comprising a first sound-insulating cover secured through an elastomeric member to said engine block and bearing support block in spaced relation to and around said engine block and said bearing support block so that noises from said engine block and said bearing supprt block are prevented from being emitted to ambient air.

10. A reciprocating piston internal combustion engine as claimed in claim 9, further comprising a second sound-insulating cover elastically secured through an elastomeric member to the cylinder head portion of said engine block in spaced relation to a rocker cover to cover the rocker cover so that noises radiated through the rocker cover are prevented from being emitted to ambient air.

11. A reciprocating piston internal combustion engine as claimed in claim 10, in which the cylinder block portion of said engine block is formed integrally with the cylinder head portion of said engine block.

12. A reciprocating piston internal combustion engine as claimed in claim 11, in which said engine block is produced by being integrally cast so that the cylinder head portion is cast integrally with the cylinder block portion.

13. A reciprocating internal combustion engine as claimed in claim 11, in which the piston stroke of each piston is smaller than the bore diameter of each cylinder.

14. A reciprocating piston internal combustion engine as claimed in claim 13, further comprising a flange to which a transmission case is secured, said flange including a first member which is integral with said engine block, and a second member which is integral with said bearing support block, said first and second member being secured to each other.

15. A reciprocating piston internal combustion engine as claimed in claim 14, said bearing support block is formed with a flange portion which is secured to a flange portion of the cylinder block portion of said engine block by means of a plurality of bolts.

16. A reciprocating piston internal combustion engine as claimed in claim 15, in which the flange portion of said bearing support block has a flat surface wihch is contactable with the flat surface of the flange portion of said cylinder block, the flange portion of said bearing support block being formed at its flat surface with a groove receiving an elongate elastomeric seal member for providing an oil-tight seal between the contacting flat surfaces of the flange portions of said bearing block and engine block.

17. A reciprocating piston internal combustion engine as claimed in claim 15, in which each of said second main bearing carrying portion of said bearing support block is of the shape of a partition wall defining an engine oil chamber, said second bearing carrying portion being formed with two elongate through holes for receiving two bolts, respectively, which are screwed into said engine block to secure said bearing support block to said engine block, said two elongate through holes lying substantially parallelly with the axes of the engine cylinders and generally symmetrically to each other with respect to the lower generally semi-cylindrical part of the main bearing, at least one of said second main bearing carrying portion being formed with an opening through which the adjacent engine oil chambers communicate with each other.

18. A reciprocating piston internal combustion engine comprising:

an engine block including a cylinder block portion in which engine cylinders are formed, and a cylinder head portion to close one ends of the cylinders to define combustion chambers between it and the crowns of pistons reciprocally disposed in the cylinders, respectively, said engine block being formed with first bearing carrying portions which carry a group of upper generally semi-cylindrical parts of main bearings for supporting the journal of a crankshaft mechanically connected to the pistons; and a bearing support block sealingly secured to said engine block and formed with a cavity to be filled with an engine lubricating oil for operating the engine so that said bearing support block serves as an oil pan, said bearing support block being formed with second bearing carrying portions which carry a group of lower generally semi-cylindrical parts of the main bearings, said bearing support block being rigid enough to securely support said second bearing carrying portions, each lower generally semi-cylindrical part constituting a generally cylindrical main bearing in cooperation with each upper generally semi-cylindrical part.

19. A reciprocating piston internal combustion engine comprising:

an engine block including a cylinder block portion in which engine cylinders are formed, and a cylinder head portion to close one ends of the cylinders to define combustion chambers between it and the crowns of pistons reciprocally disposed in the cylinders, respectively, said engine block being formed with first bearing carrying portions which carry a group of upper generally semi-cylindrical parts of main bearings for supporting the journal of a crankshaft mechanically connected to the pistons; and a bearing support block sealingly secured to said engine block and formed with a cavity to be filled with an engine lubricating oil for operating the engine so that said bearing support block serves as an oil pan, said bearing support block being formed with second bearing carrying portions which carry a group of lower generally semi-cylindrical parts of the main bearings, said bearing support block being rigid enough to securely support said second bearing carrying portions, each lower generally semi-cylindrical part constituting a generally cylindrical main bearing in cooperation with each upper generally semi-cylindrical part, said bearing support block including a vessel portion in which said cavity is formed, a plurality of partition wall portions integral with said vessel portion to separate said cavity into a plurality of oil chambers, each parition wall portion being formed with said second bearing carrying portions and further formed with an opening which provides communication between adjacent two of the oil chambers.

* * * * *